US009260922B2

(12) United States Patent
Kongamnach et al.

(10) Patent No.: US 9,260,922 B2
(45) Date of Patent: Feb. 16, 2016

(54) ROLLER CONE DRILL BIT WITH CUTTINGS EVACUATOR

(75) Inventors: Amnach Kongamnach, Lavon, TX (US); David Michel Harrington, Dallas, TX (US)

(73) Assignee: Varel International, Ind., L.P., Carrollton, TX (US)

( * ) Notice: Subject to any disclaimer, the term of this patent is extended or adjusted under 35 U.S.C. 154(b) by 836 days.

(21) Appl. No.: 13/434,583

(22) Filed: Mar. 29, 2012

(65) Prior Publication Data

US 2013/0256038 A1 Oct. 3, 2013

(51) Int. Cl.
*E21B 10/18* (2006.01)
*E21B 10/60* (2006.01)

(52) U.S. Cl.
CPC ..... *E21B 10/18* (2013.01); *E21B 10/60* (2013.01)

(58) Field of Classification Search
CPC ..... E21B 10/18; E21B 10/61; E21B 10/60; E21B 10/00; E21B 10/38
USPC ..... 175/339, 340, 231
See application file for complete search history.

(56) References Cited

U.S. PATENT DOCUMENTS

| | | | | |
|---|---|---|---|---|
| 2,692,117 | A | 10/1954 | Kucera et al. | |
| 3,099,324 | A | 7/1963 | Kucera et al. | |
| 3,727,704 | A | 4/1973 | Abplanalp | |
| 4,022,285 | A | 5/1977 | Frank | |
| 5,199,511 | A | 4/1993 | Tibbitts et al. | |
| 5,462,128 | A | 10/1995 | Gray | |
| 5,957,227 | A | 9/1999 | Besson et al. | |
| 6,082,473 | A | 7/2000 | Dickey | |
| 8,240,402 | B2 * | 8/2012 | Rickabaugh et al. | 175/340 |
| 2010/0270081 | A1 | 10/2010 | Perry, Jr. et al. | |
| 2011/0073377 | A1 | 3/2011 | Rickabaugh et al. | |

OTHER PUBLICATIONS

International Search Report and Written Opinion for PCT/US2013/022839 mailed May 15, 2013 (11 pages).

Supplementary European Search Report for EP 13767741.5 mailed Aug. 26, 2015 (6 pages).

* cited by examiner

*Primary Examiner* — Brad Harcourt
*Assistant Examiner* — Wei Wang
(74) *Attorney, Agent, or Firm* — Gardere Wynne Sewell LLP; Andre M. Szuwalski

(57) ABSTRACT

An earth boring drill bit having an alternate path to allow cuttings to be ejected or evacuated from the drill bit and up the bore hole is disclosed. The evacuation hole of the present disclosure allows larger sized cuttings to evacuate from the bit without having to be continually ground by rolling cone cutters until the cuttings are small enough to follow a path around the edge of the shirttail of the bit and up the borehole. A cuttings restrictor is disposed at the inlet of the evacuation hole. The cuttings restrictor ensures that only cuttings that are sized to move completely through the evacuation hole and exit the drill bit are allowed to enter the evacuation hole.

27 Claims, 6 Drawing Sheets

ROLLER CONE DRILL BIT WITH CUTTINGS EVACUATOR

TECHNICAL FIELD

The present invention relates generally to earth boring drill bits for drilling a wellbore, and more particularly to a roller cone rock bit with a cuttings evacuator.

BACKGROUND

Roller cone or rotary cone bits are well known in the art of earth boring drilling operations. The most common design of a roller cone bit consists of three roller cones, each rotatably mounted on a downwardly and radially inwardly extending bearing pin. Each roller cone supports a plurality of cutting elements, which are referred to as cutters. Each of the bearing pins is spaced approximately 120 degrees apart with the three pins formed as a part of a bit body. The entire structure is rotated at the end of a drill string. Boring is accomplished by applying weight to the drill bit and rotating the drill string, thereby causing the roller cones to roll and crush the rock formation beneath the bit. As the bit is rotated and moves through a formation, the cutter elements contact and disintegrate portions of the formation in order to form the desired bore hole. The earth separated from the formation become cuttings that are removed from the bottom and sides of the bore hole and washed away by a drilling fluid, such as air or drill mud, that is supplied to the drill bit from the surface through the hollow rotating drill string. The cuttings are suspended in the drilling fluid and carried to the surface in the space between the bore hole and the drill string.

The cuttings produced by the drilling operation are abrasive and with continued use will erode the cutters and other portions of the bit. The grinding and re-grinding of the cuttings produced by the drilling operation slows the formation penetration rate of the bit and shortens the life of the bit. The re-ground cuttings tend to dull the cutters and the finely ground particles may enter the bearing surfaces formed between the roller cones and the journals supported by the bit, restricting cutter cone rotation and further limiting bit life.

Reference is made to U.S. Pat. No. 6,082,473 to Dickey, which is incorporated herein by reference and discloses a self-cleaning polycrystalline diamond compact (PDC) bit.

Reference is also made to U.S. Pat. No. 5,462,128 to Gray, which is incorporated herein by reference and discloses a cutter bit having a passageway for cuttings to escape to the surface of the hole.

Further reference is made to U.S. Pat. Nos. 2,692,117 and 3,099,324 each to Kucera which disclose drill bits having passageways through the bit for the evacuation of cuttings.

SUMMARY

An earth boring drill bit having an alternate path to allow cuttings to be ejected or evacuated from the drill bit and up the bore hole is disclosed. The evacuation hole of the present disclosure allows larger sized cuttings to evacuate from the bit without having to be continually ground by rolling cone cutters until the cuttings are small enough to follow a path around the edge of the shirttail of the bit and up the borehole. A cuttings restrictor is disposed at the inlet of the evacuation hole. The cuttings restrictor ensures that only cuttings that are sized to move completely through the evacuation hole and exit the drill bit are allowed into the evacuation hole.

In certain embodiments, the drill bit may include a drilling fluid hole that extends from an inner plenum of the bit and intersects the evacuation hole. Drilling fluid may flow from the inner plenum, through the drilling fluid hole, and into the evacuation hole. This fluid flow may enhance the evacuation and ejection of cuttings from the evacuation hole.

Other embodiments of the drill bit of the present disclosure may include an excluder disposed at the outlet of the evacuation hole. The excluder may include features that partially block an opening leading to the outlet, and thus prevent debris and flushed cuttings from reentering the evacuation hole through the outlet.

Technical advantages of the disclosed drill bit include features that allow larger sized cuttings to be evacuated from the drill bit, as opposed to being reground by the cutter cones. By reducing the amount of regrinding that occurs in the drilling operation, penetration efficiency may be improved, fewer cutters may be lost, and bits may last longer.

DETAILED DESCRIPTION OF THE DRAWINGS

Figure 1:
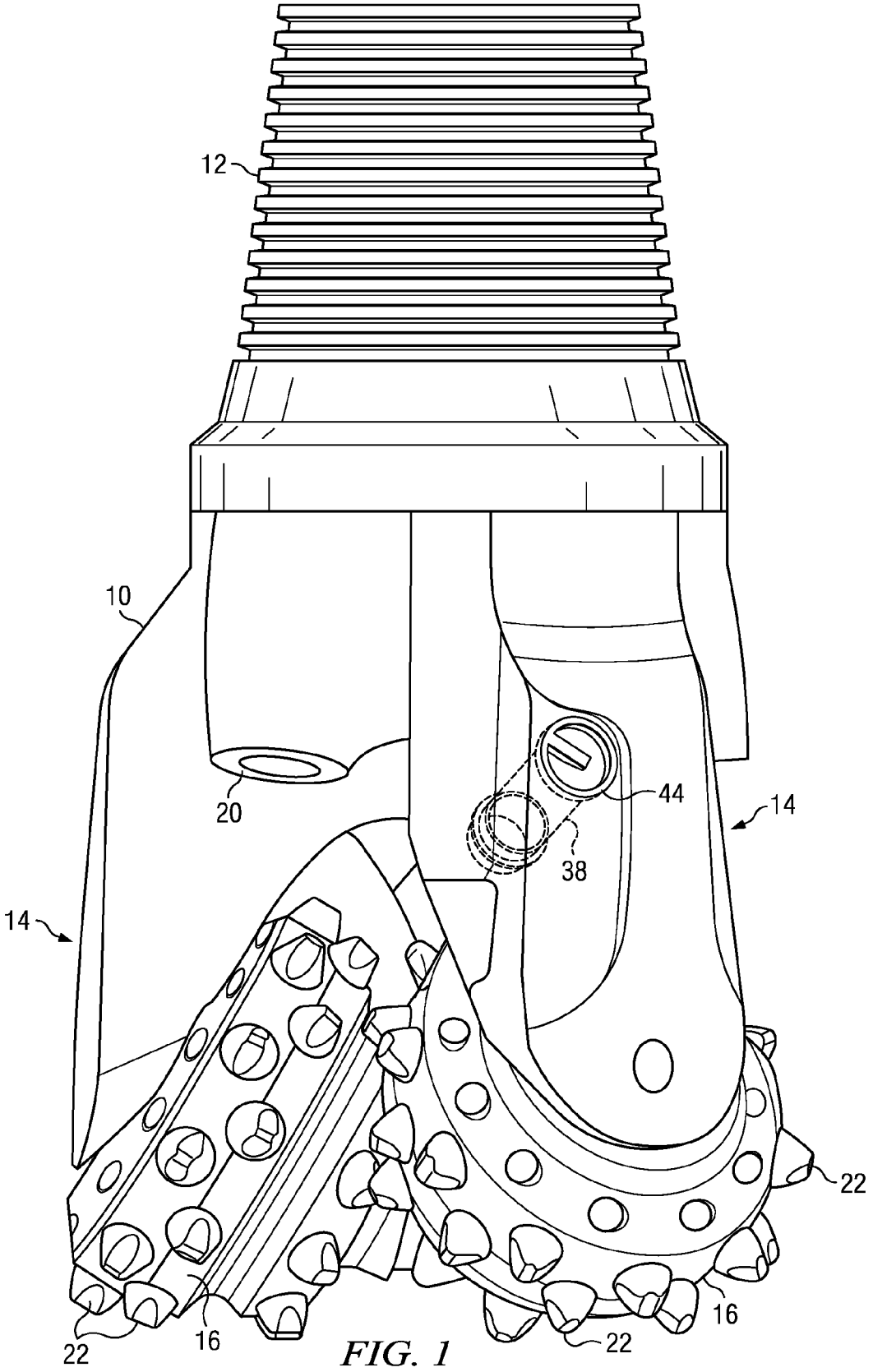
FIG. 1 is an isometric view of a roller cone drill bit with an evacuation hole according to an embodiment of the present disclosure.

Reference is made to FIG. 1, which shows a rotary cone bit including a bit body 10 having at one end a threaded shank 12 for attachment to a drill string member (not shown). The threaded shank 12 is adapted to be threadably engaged with a drill string in accordance with conventional drill bit operation. Extending from the bit body 10 are three leg portions 14 (only two of which are shown), each providing support for a rotatable roller cutter cone 16. Both the bit body 10 and the shank 12 have an axially extending passageway defining an internal plenum (see FIG. 2). Drilling fluid is directed through the plenum and exits at nozzles 20 (only one shown). The drilling fluid may be air, liquid (water or mud), foam, or any combination thereof. For example, a liquid such as drilling mud may be employed to flush the bore hole of debris during the drilling operation. A nozzle 20 is positioned between each pair of cones. Each of the nozzles may be surrounded by a hard facing ring for improved wear resistance against debris circulating around the drill bit during a drilling operation in a bore hole. The nozzles 20 may be interchangeable jet nozzles, which may be sized to achieve a desired pressure drop of the drill fluid.

As illustrated in FIG. 1, the roller cutter cones 16 each have substantially the same base diameter to permit cutting teeth 22 on each cone to project between cutting 22 teeth of the other cutter cones. The cutting teeth 22 on each of the cutter cones 16 are arranged in rows. The cutters may be any material suitable for removing and crushing an earth formation and such material may depend on the composition of the formation being drilled. In the embodiment shown, the cutter teeth 22 comprise tungsten carbide inserts press fit into the cone surface and projecting therefrom. An evacuation hole 38 is illustrated by broken lines in FIG. 1. The evacuation hole 38 extends at an angle through the leg of the bit and provides a passageway between a central region of the bit between the cones 16 and an external surface of the bit leg 14. Embodiments of the present disclosure may include an evacuation hole 38 through each leg 14 of the bit. Thus, a bit may have three legs 14 where each leg defines an evacuation hole 38. However, one evacuation hole 38 for a single bit may be sufficient. Cuttings separated from the formation by the roller cones 16 flow through the evacuation hole 38, past a flushed cuttings excluder, and into the space between the bit body 10 and the borehole wall.

Figure 2:
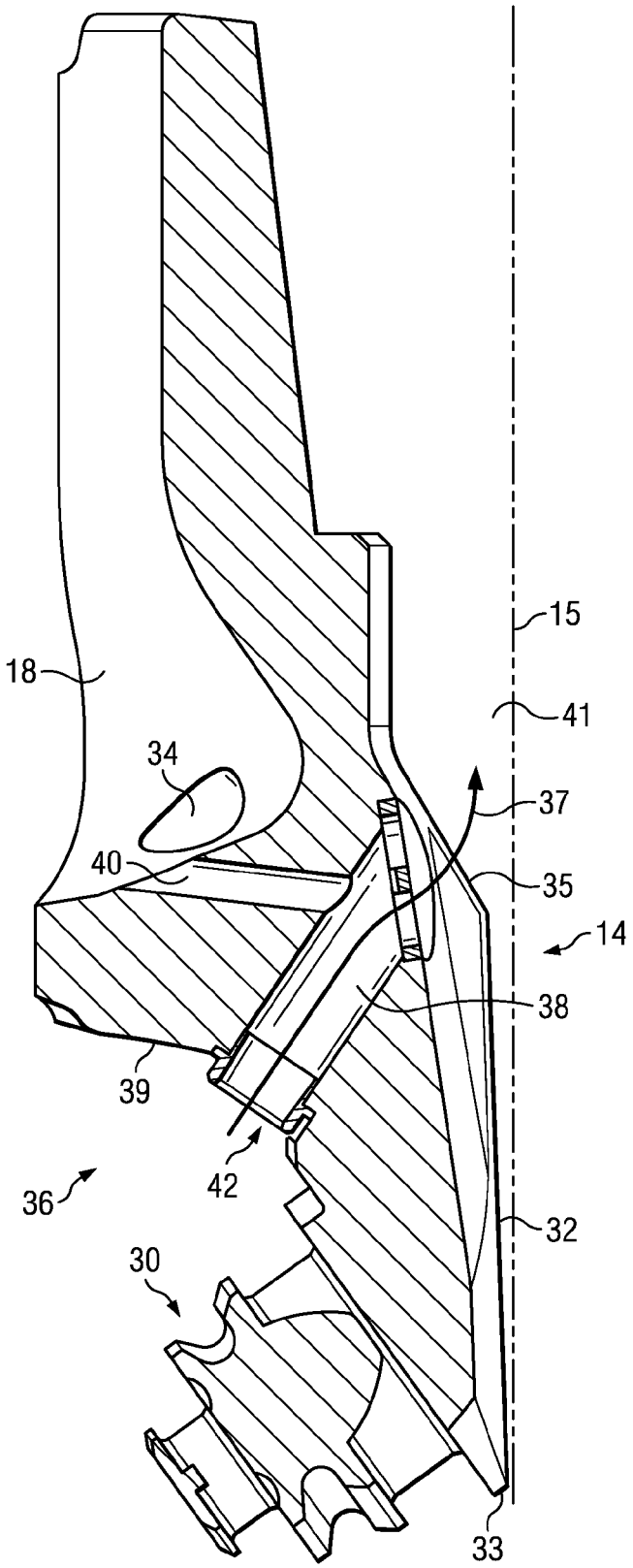
FIG. 2 is a cross section of a portion of the roller cone drill bit of FIG. 1.

Reference is made to FIG. 2, which is a cross section of a portion of the rotary cone bit of FIG. 1. The cross section shows one leg 14 and one pin 30 extending from the leg 14. The pin 30 provides the bearing and sealing surfaces that interface with corresponding surfaces of the roller cone 16, which has been removed for clarity. The cutter cones rotate about the axis of the pin 30. This axis of rotation is inclined with respect to the vertical axis of the bit. An exterior portion of the leg 14 is known as the shirttail 32.

Drilling fluid is directed through the drill string and reaches the plenum of the bit, which is defined by an interior plenum surface 18. From the plenum the fluid is received by one or more discharge ports 34. Drill bits usually have one discharge port 34 per roller cone. Fluid flows through the discharge ports 34 and exits to the bit cavity 36 located in a central region of the bit among the cones and between the cones and a surface of a throat area 39.

The drilling fluid serves to keep the bit cool. For example, roller cone bits often have non-sealed rolling element bearings that support the roller cones 16 as they rotate. Some of the drilling fluid may be directed to flow through channels internal to the bit body 10 to these bearings in order to keep them cool during down hole operation.

The drilling fluid also functions to flush earth cuttings out of the bit cavity 36, around the shirttail 32, and up the borehole. For cuttings to be flushed out through this path, they must be sufficiently small to fit between the shirttail 32 and the wall of the borehole. Larger cuttings may not be immediately flushed from the bit cavity 36. Rather, they may be reground by the cutters until the cuttings are small enough to flow with the drilling fluid between the shirttail 32 and the borehole wall. This regrinding reduces bit efficiency and accelerates bit and cutter wear. Also, the drilling fluid is susceptible to recirculation in the cavity 36 near the discharge nozzles 20, which can cause erosion and coring problems with the bit near the nozzles 20. In addition, continuous grinding of larger cuttings may lead to loss of cutter inserts, may reduce bit life, and may reduce bit penetration.

According to an embodiment of the present disclosure, drilling fluid may flush earth cuttings away from the roller cone cutters 16 and the bit through a passageway defined by an evacuation hole 38. The evacuation hole 38 may be formed through the leg 14 and may be at any suitable angle. An evacuation hole 38 may be formed through a single leg 14, all the legs 14, or less than all the legs 14. In certain embodiments, the evacuation hole 38 may be a constant diameter straight hole as shown in FIG. 2. In other embodiments, the evacuation hole 38 may be an increasing diameter tapered hole 38' (as shown in FIG. 3C), where the diameter of the tapered hole 38' increases toward the outlet. The evacuation hole 38 may also range in diameters. Thus, larger bits may support a larger diameter evacuation hole 38. The evacuation hole 38 may be formed in the bit leg 14 by drilling, milling, plunge electro-discharge machining or any suitable process for removing material. A milled evacuation hole 38 may be generally slot-shaped, as opposed to cylindrical.

In certain embodiments, an interior surface of the evacuation hole 38 may support a sleeve. The sleeve may run the length of the evacuation hole 38 and may extend into the cavity 36 as further detailed below with respect to the description of the cuttings restrictor 42. The sleeve may be employed to provide an abrasion/erosion resistant inner surface for the evacuation hole 38, which may resist wear caused by cuttings being evacuated through the bit. The sleeve may comprise any suitable abrasion/erosion resistant material, such as tungsten carbide, a glass filled polymer, or a ceramic. The sleeve may have a tapered inner surface to assist in the prevention of clogging. The tapered surface may be an interior surface of the sleeve, while the exterior surface of the sleeve corresponds to the geometry of the evacuation hole 38.

The outlet of the evacuation hole 38 may be formed in any portion of the backside surface of the leg 14 that is up hole of the bottom edge 33 of the shirttail 32. For example, the outlet may be formed in a surface adjacent an upper shoulder surface 35 and may be on the leading or trailing side of the leg 14. In other embodiments, it may be formed partially in the shoulder surface and partially in the outer (gage or shirttail surface) of the leg 14. Still further, the outlet may be formed in the outer surface of the leg 14.

The cuttings follow path 37 and enter the evacuation hole 38 from the bit cavity 36 and exit from the outlet into the space 41 between the bit body 10 and the borehole wall 15.

The entry portion of the evacuation hole 38 may be through a surface of the bit generally in the throat area 39. In certain embodiments, the evacuation hole 38 may include features at its inlet that prevent cuttings from becoming lodged in the evacuation hole 38, and may include features at its outlet that prevent re-entry of flushed cuttings or other debris in the evacuation hole 38.

According to one embodiment, the evacuation hole 38 may be in fluid communication with a drilling fluid hole 40, which is connected to the plenum. The drilling fluid hole 40 may be smaller in diameter than the evacuation hole 38. The drilling fluid hole 40 may be defined by the plenum at one end and an intersection with the evacuation hole 38 at the other end. Similar to the evacuation hole 38, the drilling fluid hole 40 may be formed by drilling, plunge electro-discharge machining, or milling.

In certain embodiments, the drilling fluid hole 40 may intersect an up-hole portion of the evacuation hole 38. Drilling fluid flowing through the plenum may also flow through the drilling fluid hole 40 and into the evacuation hole 38. This flow will help draw cuttings into and completely through the evacuation hole 38. In this manner, cuttings may be drawn through the evacuation hole 38 to be ejected away from the bit. Some embodiments of the present disclosure may effectively evacuate and remove cuttings from the cavity 36 without a drilling fluid hole 40.

Figure 3A:
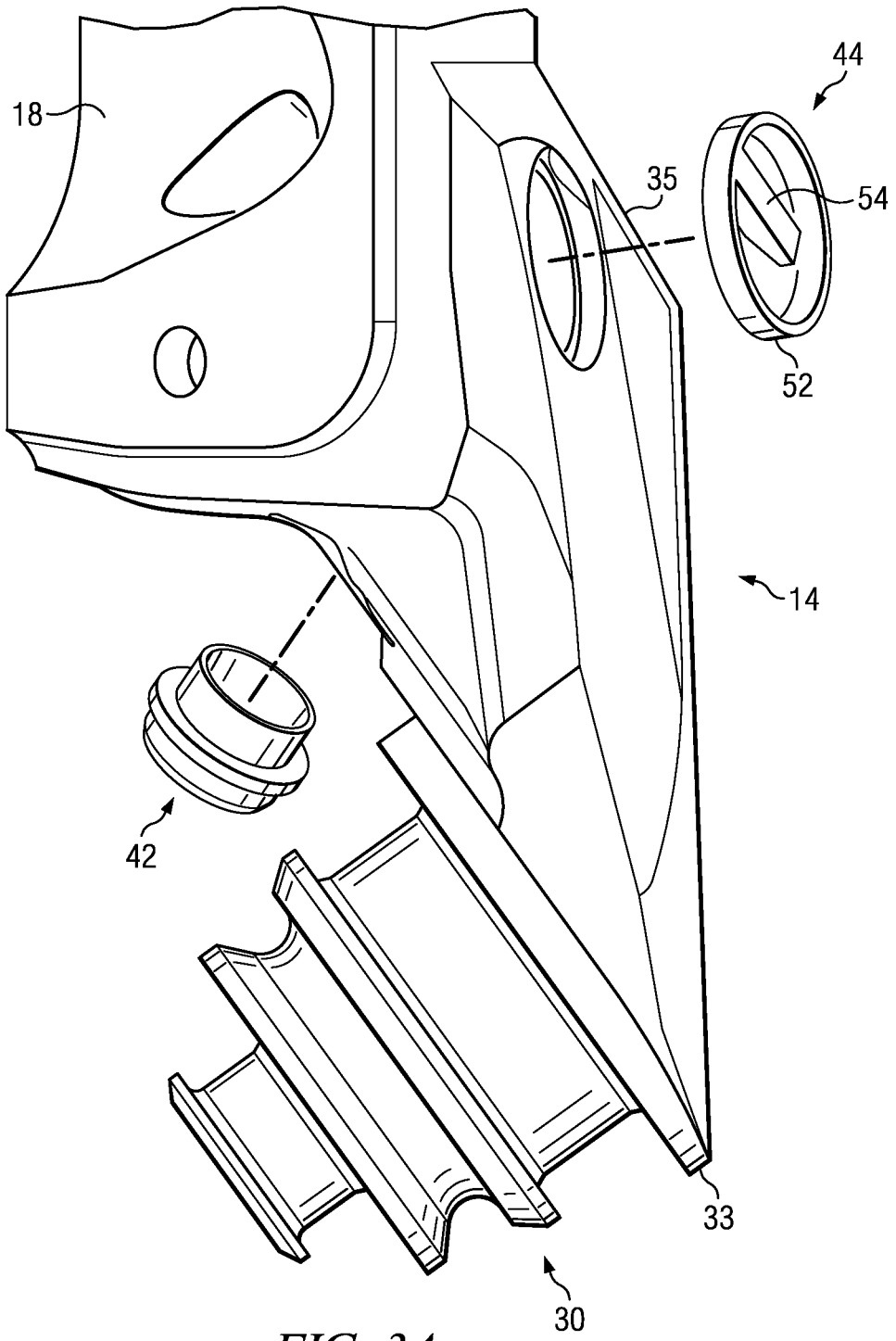
FIG. 3A is an isometric view of a portion of a roller cone drill bit according to an embodiment of the present disclosure.
Figure 3B:
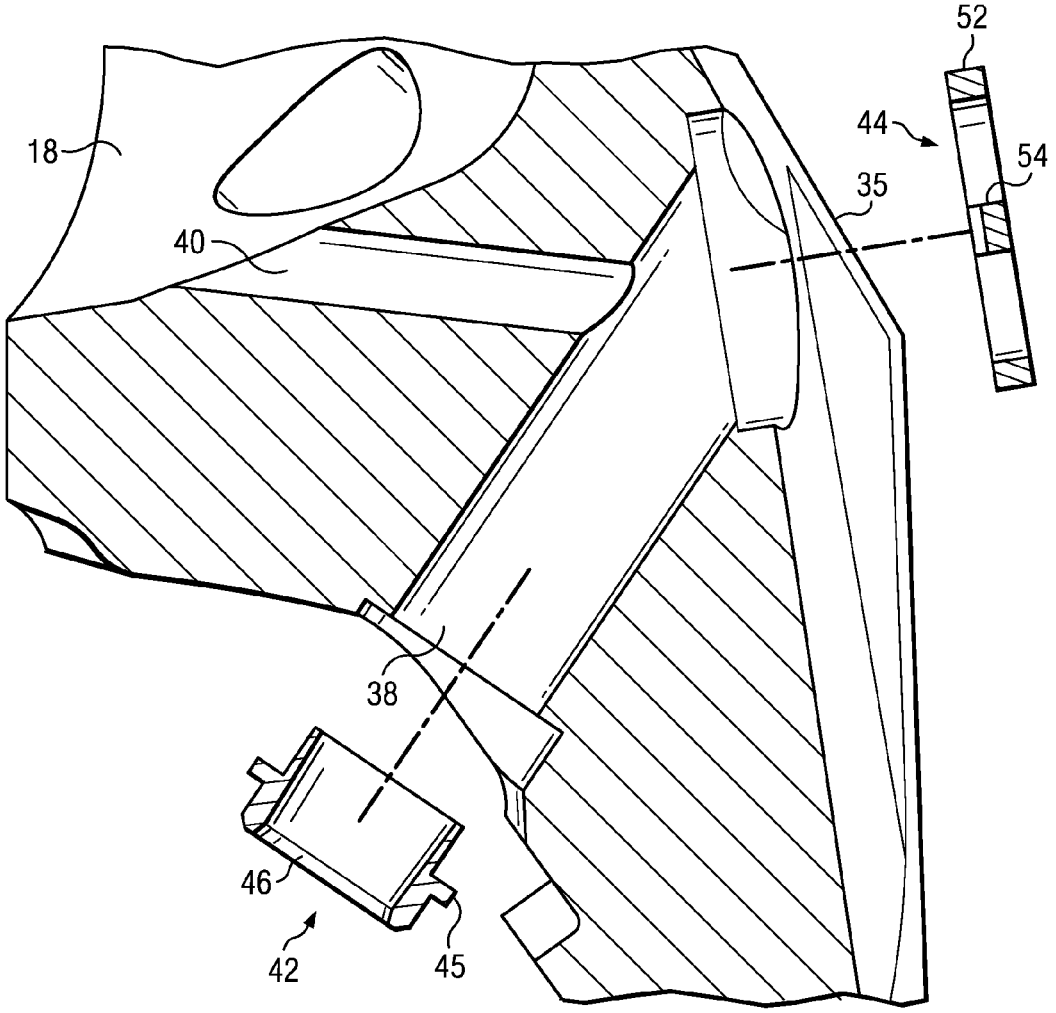
FIG. 3B is a cross section of the portion of the roller cone drill bit of FIG. 3A.
Figure 3C:
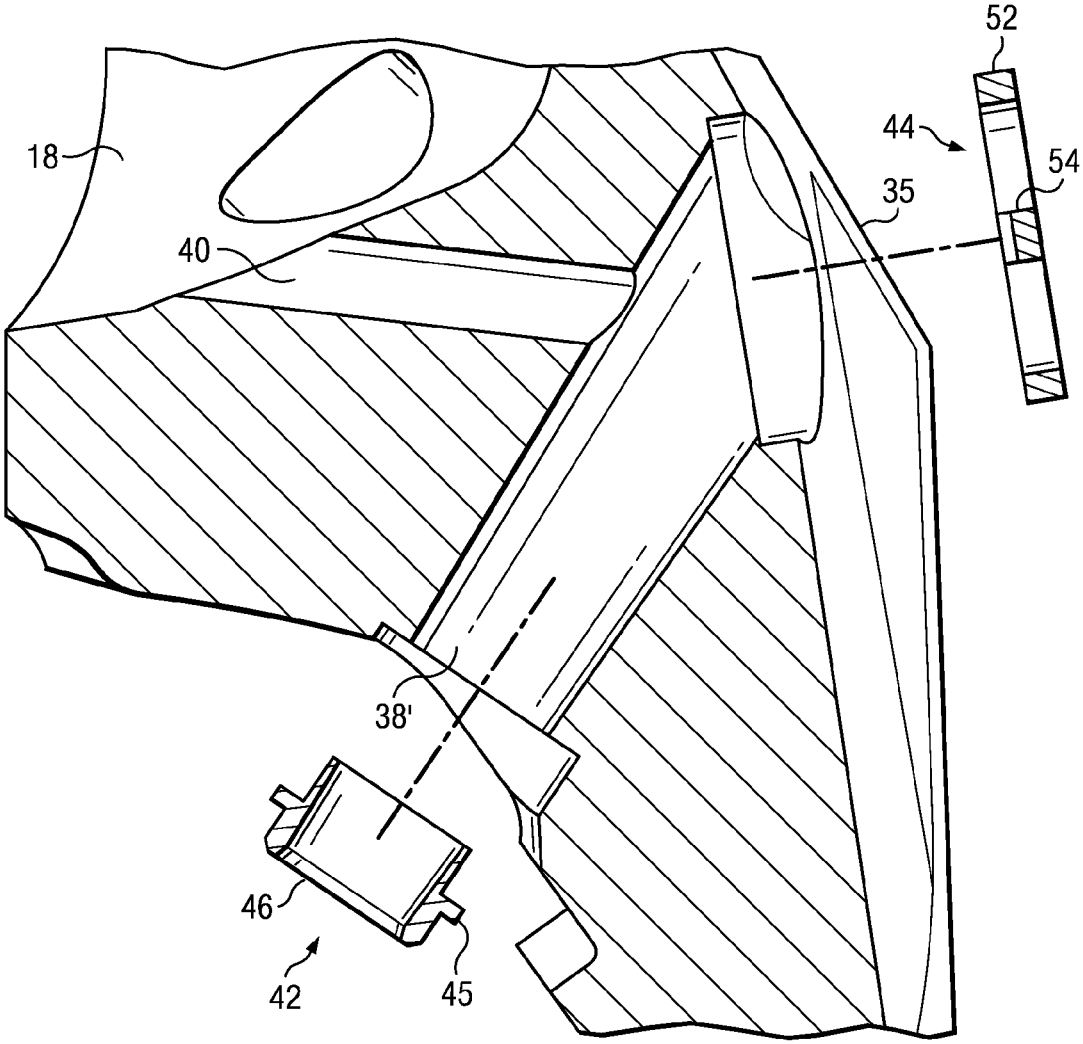
FIG. 3C is a cross section of a portion of a roller cone drill bit having a tapered evacuation hole.

Reference is now made to FIG. 3A, which shows an isometric view of a portion of the drill bit of FIGS. 1 and 2. FIG. 3B shows the bit in cross-section. FIGS. 3A and 3B show, exploded from the bit, a cuttings restrictor 42 at the inlet of the evacuation hole 38 and a flushed cuttings excluder 44 exploded from the outlet of the evacuation hole 38. The cuttings restrictor 42 and the flushed cuttings excluder 44 may be formed from any suitable abrasion or erosion resistant material including steel, tungsten carbide, a glass filled polymer, or a ceramic material. In certain embodiments, the restrictor and excluder features described herein may be formed integral with the bit body 10. The cuttings restrictor 42 and the flushed cuttings excluder 44 may fit into respective countersunk holes formed in the bit. The restrictor 42 and excluder 44 may be press fit, glued, screwed or otherwise secured into the countersunk holes.

Figure 4A:
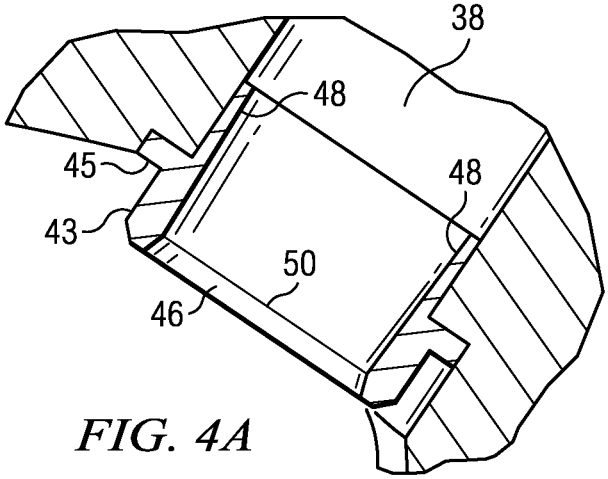
FIG. 4A is a detailed view of an inlet of the evacuation hole and a cuttings restrictor according to an embodiment of the present disclosure.

FIG. 4A illustrates a detailed view of the cuttings restrictor 42 secured to the bit. As shown in FIG. 4A, at least a portion of the cuttings restrictor 42 extends into the bit cavity 36 from the interior surface of the throat 40 of the bit. In certain embodiments, the restrictor may have an external annular portion 43 delimited by a flange 45. The annular portion 43 may extend ⅛ inch, or ¼ inch, or up to approximately one-half inch into the cavity 36. In other embodiments, the annular portion 43 may extend up to one inch into the cavity 36. The restrictor 42 may extend into the cavity any suitable distance such that it does not interfere with the roller cutter cones 16. Extension into the cavity allows the restrictor 42 to perform its function of restricting larger sized cuttings from entering the evacuation hole 38. When a cutting that is sized too large to fit through the evacuation hole 38 contacts the restrictor 42, it may be held in place by the restrictor 42 until the vibration of the bit or shutting off the flow of the drilling fluid allows the large sized particle to fall away from the restrictor 42.

Although FIG. 4A shows only an up-hole perimeter of the annular portion 43 extending into the cavity 36, in certain embodiments, the down-hole perimeter of the annular portion 43 may also extend into the cavity 36. The cuttings restrictor 42 need not have a cylindrical opening. The restrictor 42 may be any suitable shape that restricts cuttings that are sized to clog the evacuation hole 38 from entering the evacuation hole 38. In certain embodiments, the an inlet of the cuttings restrictor may have an asymmetrical shape.

A beveled surface 46 may be interior to the annular portion 43. The beveled surface 46 transitions to a tapered inner surface 48. The inner perimeter where this transition occurs may be a minimum diameter 50 of the restrictor 42. This minimum diameter 50 ensures that if a cutting particle passes the minimum diameter 50, then it will continue to move or flow through the portion of the restrictor 42 defined by the tapered inner surface 48 and on through the larger diameter evacuation hole 38. In this manner, only cuttings that are sized to completely exit the bit through the evacuation hole 38 may enter through the restrictor 42.

Figure 4B:
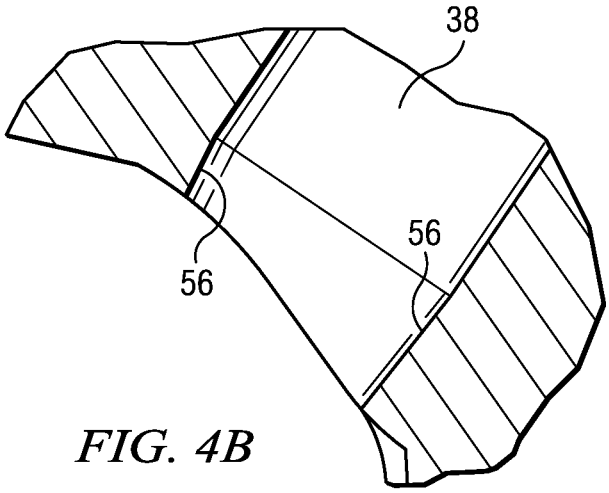
FIG. 4B is a detailed view of a tapered inlet portion of an evacuation hole according to an alternate embodiment of the present disclosure.

FIG. 4B illustrates an alternate embodiment of the present disclosure where a tapered surface similar to the tapered surface 48 of the cuttings restrictor 42 has been machined directly into the bit. As such, the evacuation hole 38 includes a tapered inlet portion 56. Similar to the tapered surface of the cuttings restrictor 42, the tapered inlet portion 56 has a minimum diameter that restricts cuttings that are not sized to pass completely through the evacuation hole 38 from entering the evacuation hole 38.

Returning to FIGS. 3A and 3B, a cuttings excluder 44 is shown. The cuttings that flow through the evacuation hole 38 reach the flushed cuttings excluder 44 at the outlet of the evacuation hole 38. The flushed cuttings excluder 44 comprises a ring 52, which supports a prong 54. An alternate embodiment comprises the prong 54 or similar excluding member that is supported by the bit body 10, as opposed to a separate ring. The prong 54 ensures that cuttings that have already been flushed away from the bit and up the bore hole or any other debris, do not reenter the evacuation hole 38 through the outlet. Also, particles that become dislodged from the bore hole wall or are otherwise present in the bore hole may be prevented from entering the evacuation hole 38 through the outlet. In certain embodiments, the prong 54 may extend across the ring 52 less than the full diameter of the excluder 44. The flushed cuttings excluder 44 may comprise a hinged steel prong which opens towards the exterior of the bit. In this manner, cuttings flowing through the evacuation hole 38 or the fluid pressure flowing through the evacuation hole 38 may open the prong to allow cuttings to exit through the flushed cuttings excluder 44. However, when the drilling air/mud/foam pressure is removed and cuttings are no longer flowing through the evacuation hole 38, the spring of the prong 54 may bias the prong 54 in its resting position where it can block cuttings from falling into the outlet of the evacuation hole 38 from the top side of the bore hole downward.

The flushed cuttings excluder 44 including the ring 52 and the prong 54 also may be positioned at the inlet of the evacuation hole in lieu of the restrictor 42.

Thus, according to the teachings of the present disclosure, an alternate path for cuttings to be ejected or evacuated from a drill bit and up the bore hole is disclosed. The evacuation hole 38 of the present disclosure allows larger sized cuttings to evacuate from the bit without having to be continually ground by the rolling cone cutters 16 until the cuttings are small enough to follow the path around the edge of the shirt-tail of the bit and up the borehole. In this manner, cutter or bit failure may be prevented and drilling efficiency may be improved.

Embodiments of the invention have been described and illustrated above. The invention is not limited to the disclosed embodiments.

What is claimed is:

1. A drill bit, comprising:

a plurality of legs, each leg defining an evacuation hole having an inlet and an outlet, each inlet configured to receive cuttings from a cavity of the drill bit, the cuttings moving through the evacuation holes and exiting the drill bit through the outlets;

a plurality of cuttings restrictors each cuttings restrictor secured to a respective leg at the inlet and partially obstructing the evacuation hole, the cuttings restrictor configured to allow only cuttings sized to pass through the evacuation hole to enter the evacuation hole, the cuttings restrictor being formed separately from the leg; and a plurality of drilling fluid holes, each drilling fluid hole extending from an inner plenum of the drill bit and intersecting a respective evacuation hole.

2. The drill bit of claim 1 wherein each cuttings restrictor comprises a tapered inner surface increasing in diameter as the tapered inner surface extends into the evacuation hole.

3. The drill bit of claim 2 further comprising a plurality of rotatable cutter cones disposed in the cavity.

4. The drill bit of claim 3 wherein a portion of each cuttings restrictor extends into the cavity of the drill bit.

5. The drill bit of claim 1 wherein each cuttings restrictor comprises steel.

6. The drill bit of claim 1 wherein each cuttings restrictor comprises a tapered interior surface being generally cylindrical and having an increasing diameter as the tapered inner surface extends into the evacuation hole.

7. The drill bit of claim 6 further comprising a plurality of excluders each excluder disposed at the outlet of a respective evacuation hole and configured to block debris from entering the evacuation hole through the outlet.

8. The drill bit of claim 1 wherein each drilling fluid hole intersects the evacuation hole proximate the outlet of the evacuation hole.

9. The drill bit of claim 1 wherein each cuttings restrictor comprises a tapered interior surface having a diameter increasing as the tapered surface extends into the evacuation hole.

10. The drill bit of claim 1 wherein each evacuation hole is tapered.

11. The drill bit of claim 1 further comprising a plurality of drilling fluid holes each drilling fluid hole extending from an inner plenum of the drill bit to a respective evacuation hole, an intersection of the drilling fluid hole and the evacuation hole being located closer to the outlet than the inlet.

12. A roller cone drill bit, comprising:

a bit body defining an inner plenum configured to contain a drilling fluid;

a plurality of roller cutter cones disposed in a cavity of the roller cone drill bit;

a plurality of legs extending from the bit body, each leg defining an evacuation hole having an inlet and an outlet, the inlets configured to receive cuttings from the cavity, the cuttings exiting the evacuation holes through the outlets; and a plurality of drilling fluid holes each drilling fluid hole having a first end intersecting the inner plenum and a second end intersecting a respective evacuation hole.

13. The roller cone drill bit of claim 12 further comprising a plurality of cuttings restrictors each cuttings restrictor disposed at and partially obstructing a respective evacuation hole, the cuttings restrictor configured to allow cuttings sized to pass through the evacuation hole to enter the evacuation hole, a portion of the cuttings restrictor projecting into the cavity.

14. The roller cone drill bit of claim 13 wherein each cuttings restrictor comprises a tapered inner surface increasing in diameter as the tapered inner surface extends into the evacuation hole.

15. The roller cone drill bit of claim 14 further comprising a plurality of excluders each excluder disposed at the outlet of the respective evacuation hole and configured to block debris from entering the respective evacuation hole through the outlet.

16. The roller cone drill bit of claim 15 further comprising a prong blocking at least a portion of an opening of each excluder.

17. The roller cone drill bit of claim 12 wherein each evacuation hole is tapered.

18. The roller cone drill bit of claim 12 wherein each intersection of the drilling fluid hole and the evacuation hole is located closer to the outlet than the inlet.

19. A roller cone rock bit, comprising:

a bit body defining an inner plenum configured to contain a drilling fluid;

a plurality of roller cutter cones disposed in a cavity of the roller cone rock bit;

a plurality of legs, each leg extending from the bit body and defining an evacuation hole having an inlet and an outlet, the inlet configured to receive cuttings from the cavity, the cuttings exiting the evacuation hole through the outlet;

a plurality of drilling fluid holes, each drilling fluid hole having a first end intersecting the inner plenum and a second end intersecting a respective evacuation hole;

a plurality of cuttings restrictors each disposed at and partially blocking a respective evacuation hole, each cuttings restrictor having a generally cylindrical inner tapered surface increasing in diameter as the surface extends into the respective evacuation hole; and a plurality of excluders each disposed at a respective outlet and having a prong at least partially blocking an opening of the excluder, the prong configured to open to allow cuttings to exit the respective evacuation hole.

20. The roller cone rock bit of claim 19 wherein an annular portion of at least one of the cuttings restrictors projects at least 0.25 inches into the cavity.

21. The roller cone rock bit of claim 20 wherein at least one of the evacuation holes is a tapered hole.

22. A roller cone drill bit, comprising:

a bit body defining an inner plenum configured to contain a drilling fluid;

a plurality of roller cutter cones disposed in a cavity of the roller cone drill bit;

a plurality of legs extending from the bit body, at least one leg having an evacuation hole having an inlet formed in a throat area of the at least one leg and an outlet, the inlet configured to receive cuttings from the cavity, the cuttings exiting the evacuation hole through the outlet;

a cuttings restrictor disposed at the inlet, the cuttings restrictor comprising a tapered inner surface increasing in diameter as the tapered inner surface extends into the evacuation hole; and a drilling fluid hole having a first end intersecting the inner plenum and a second end intersecting the evacuation hole wherein the intersection of the drilling fluid hole and the evacuation hole is located closer to the outlet than the inlet.

23. The roller cone drill bit of claim 22 wherein the cuttings restrictor is secured to and formed separately from the at least one leg.

24. The roller cone drill bit of claim 23 wherein the cuttings restrictor is directly formed in the at least one leg.

25. The roller cone drill bit of claim 22 wherein a second leg of the plurality of legs defines a second evacuation hole having a second inlet and a second outlet and a second drilling fluid hole intersects the second evacuation hole.

26. The roller cone drill bit of claim 23 wherein the evacuation hole is generally cylindrical and extends at an angle through the at least one leg.

27. The roller cone drill bit of claim 26 wherein the evacuation hole is tapered.

* * * * *